US009187941B2

(12) United States Patent
Therrien

(10) Patent No.: US 9,187,941 B2
(45) Date of Patent: Nov. 17, 2015

(54) ROLLER ASSEMBLY FOR SLIDING DOOR

(76) Inventor: Gerard Therrien, St-Apollinaire (CA)

( * ) Notice: Subject to any disclaimer, the term of this patent is extended or adjusted under 35 U.S.C. 154(b) by 14 days.

(21) Appl. No.: 13/374,906

(22) Filed: Jan. 23, 2012

(65) Prior Publication Data

US 2012/0247024 A1 Oct. 4, 2012

Related U.S. Application Data

(63) Continuation-in-part of application No. 12/454,142, filed on May 13, 2009, now abandoned.

(51) Int. Cl.
*E05D 15/06* (2006.01)
*E06B 3/46* (2006.01)

(52) U.S. Cl.
CPC ..... *E05D 15/0621* (2013.01); *E06B 3/4636* (2013.01); *E05Y 2900/132* (2013.01)

(58) Field of Classification Search
CPC ..... E05D 15/06; E05D 15/00; E05D 15/0626; E05D 15/0621; E05D 15/0639; E06B 3/00; E06B 3/26; E06B 3/30; E06B 3/341; E06B 3/36; E06B 3/38; E06B 3/41; E06B 3/42; E06B 3/44; E06B 3/4346; E06B 3/46; E06B 3/4415; E06B 3/4407; E06B 3/48; E06B 3/50; E06B 3/5027; E06B 3/54; E06B 3/68; E06B 3/70; E06B 3/7001; E06B 3/82; E06B 3/827; E06B 3/90; E06B 3/92
USPC ..... 160/369, 371, 405; 49/409, 425, 420, 49/506; 16/102, 105, 106, 91
See application file for complete search history.

(56) References Cited

U.S. PATENT DOCUMENTS

| | | | | | |
|---|---|---|---|---|---|
| 3,085,298 | A | * | 4/1963 | Metzger | 49/417 |
| 3,108,547 | A | * | 10/1963 | Shaver | 410/131 |
| 3,397,487 | A | * | 8/1968 | Hunt et al. | 49/130 |
| 3,416,183 | A | * | 12/1968 | Martin | 16/105 |
| 3,526,995 | A | * | 9/1970 | Saunders | 49/420 |
| 3,879,893 | A | * | 4/1975 | Helmick | 49/420 |
| 3,956,854 | A | * | 5/1976 | Yamamoto | 49/425 |
| 3,959,849 | A | * | 6/1976 | Marquardt | 16/105 |
| 4,189,870 | A | * | 2/1980 | Helmick | 49/420 |
| 4,253,278 | A | * | 3/1981 | Dallaire | 49/420 |
| 4,262,451 | A | * | 4/1981 | Dallaire | 49/425 |
| 4,353,186 | A | * | 10/1982 | Offterdinger | 49/420 |
| 4,873,741 | A | * | 10/1989 | Riegelman | 16/105 |
| 5,148,630 | A | * | 9/1992 | Llorens | 49/425 |
| 5,161,330 | A | * | 11/1992 | Auriemma | 49/420 |
| 5,845,363 | A | * | 12/1998 | Brempell et al. | 16/105 |

* cited by examiner

*Primary Examiner* — Katherine Mitchell
*Assistant Examiner* — Marcus Menezes
(74) *Attorney, Agent, or Firm* — Eric Fincham

(57) ABSTRACT

A roller assembly for use with a sliding door, the roller assembly comprising upper and lower housings, a roller mounted in the upper housing, a shaft extending between the upper and lower housings with a spring extending about the shaft, and a screw-threaded member for securing the lower housing to the shaft at a desired location. The arrangement permits self adjustment of the door within a channel.

5 Claims, 4 Drawing Sheets

ROLLER ASSEMBLY FOR SLIDING DOOR

The present application is a continuation-in-part of application Ser. No. 12/454,142 filed May 13, 2009 now abandoned.

FIELD OF THE INVENTION

The present invention relates to doors slidable in a track and more particularly, relates to an improved sliding door for easy installation.

BACKGROUND OF THE INVENTION

Sliding doors are widely used for many different applications and thus their structure can vary greatly. In many instances wherein sliding doors are installed in locations such as cupboards and the like, the door typically is hung so that a roller mounted assembly at the top slides in a track. At the bottom, normally the only hardware consists of guides for the lower part of the door. Such a guide is particularly prevalent when two such doors are designed to overlap so that one may gain access to the cupboard or other location.

A different type of sliding door is that which is commonly known as a patio door. In these structures, typically the door and more so the screen door slides in a lower track and an upper track. Such sliding doors typically are mounted on a pair of lower rollers and a pair of upper rollers. Means are provided for adjusting the height or depth of the rollers, the adjusting mechanism normally being located close to the upper/lower track as the adjustment is mechanical. The adjustment requires a certain amount of experimenting with the adjusting mechanism when one is not familiar with the same.

When installing the sliding door, usually some adjustment is required and if the installation is being done by someone without experience in the field, a proper adjustment may not be achieved and/or considerable time is spent making the adjustment.

SUMMARY OF THE INVENTION

It is an object of the present invention to provide a sliding door wherein the roller mechanism or assembly can be retracted within the door frame while means are provided for allowing the roller to slide within the track and wherein the roller is spring biased.

It is a further object of the present invention to provide a roller assembly suitable for use with a sliding door such as a screen door and which can perform a self adjustment to deal with a round header and/or sill.

It is a further object of the present invention to provide a roller assembly which will ensure a long lasting glide of the sliding door and prevent derailment of the same.

According to one aspect of the present invention, there is provided a roller assembly suitable for use with a sliding door, the roller assembly comprising an upper housing, a roller mounted in the upper housing, a shaft, a spring extending about the shaft, a lower housing movable along a lower portion of the shaft, and means for securing the lower housing to the shaft at a desired location.

According to a further aspect of the present invention, there is provided a screen door having a frame, a screen extending about an aperture, and at least one roller mechanism in an upper portion of the door, the roller mechanism comprising a roller housing, a roller mounted in the roller housing, a lower stop member, a shaft extending between the roller housing and the lower stop member, the lower stop member being movable along a lower portion of the shaft, a spring extending about the shaft and abutting the roller housing and the lower stop member, the lower stop member being secured to the shaft such that the roller is retained within the door frame.

According to a further aspect of the present invention, there is provided a method of installing a screen door within a door frame comprising the steps of supplying a screen door having the screen door frame, a screen extending about an aperture, and first and second roller mechanisms in an upper portion of the door, each of the roller mechanisms each having an upper housing, a roller mounted in the upper housing, a shaft, a spring extending about the shaft, a lower housing moveable along a lower portion of the shaft and means for securing the lower housing to the shaft at a desired location, the lower housing being secured to the shaft in a shortened position, placing the screen door within the door frame at a desired location, and releasing each of the means for securing the lower housings to the shafts whereby the upper housings and rollers will extend outwardly of the door frame to thereby lock the screen door in position.

The roller assembly of the present invention can be used in any suitable sliding door. The most common use would be in screen doors usually associated with sliding patio doors.

The roller assembly is preferably used in sets—one being located or proximate to the left and right-hand door edges. The roller assemblies may be used either at the top or bottom of the door or preferably on both the top and bottom.

Preferably, the roller assemblies are installed at the factory and the arrangement may be one wherein the rollers are held in a retracted position. Subsequently, upon installation, the rollers are permitted to be released as will be discussed in greater detail hereinbelow.

An advantage of the roller assembly of the present invention is that the adjustment screw is located a substantial distance away from the tracks so as to prevent finger injuries when doing the adjustment. Normally, any adjustment screw is located proximate the top edge of the door; preferably, the adjustment screw according to the present invention is located at least four inches away from the top of the door.

BRIEF DESCRIPTION OF THE DRAWINGS

Having thus generally described the invention, reference will be made to the accompanying drawings illustrating an embodiment of the present invention in which.

DETAILED DESCRIPTION OF THE INVENTION

Figure 1:
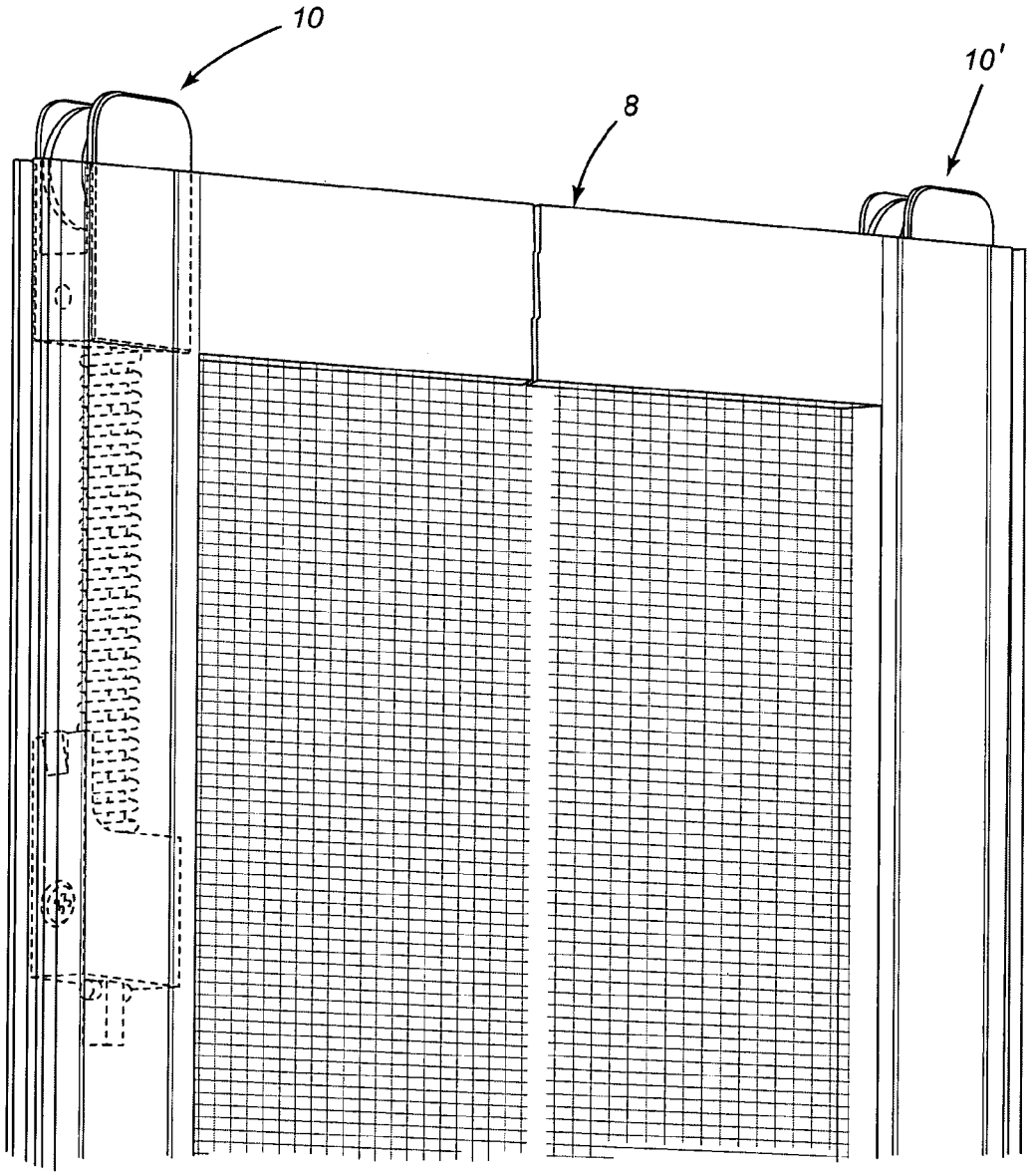
FIG. 1 is a perspective view of an upper portion of a sliding screen door illustrating placement of one of the roller assemblies.
Figure 2:
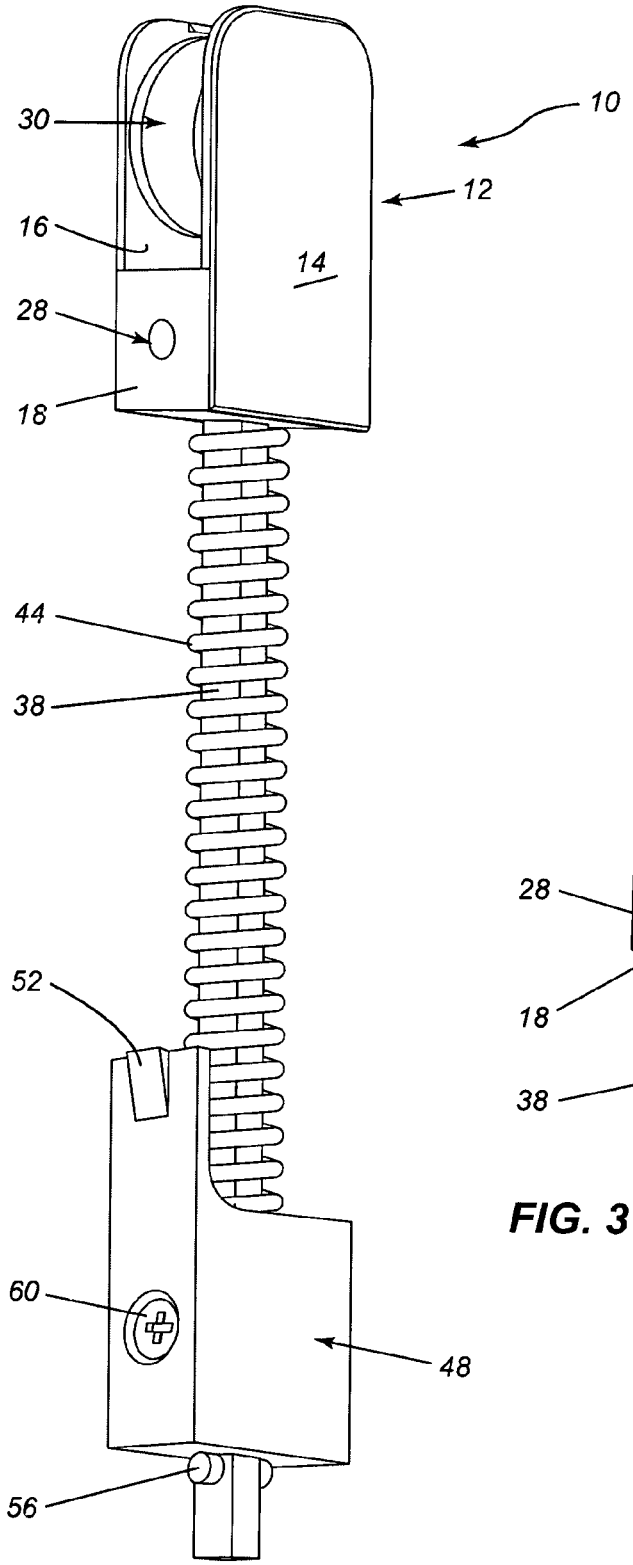
FIG. 2 is a perspective view of a roller assembly according to an embodiment of the present invention.
Figure 3:
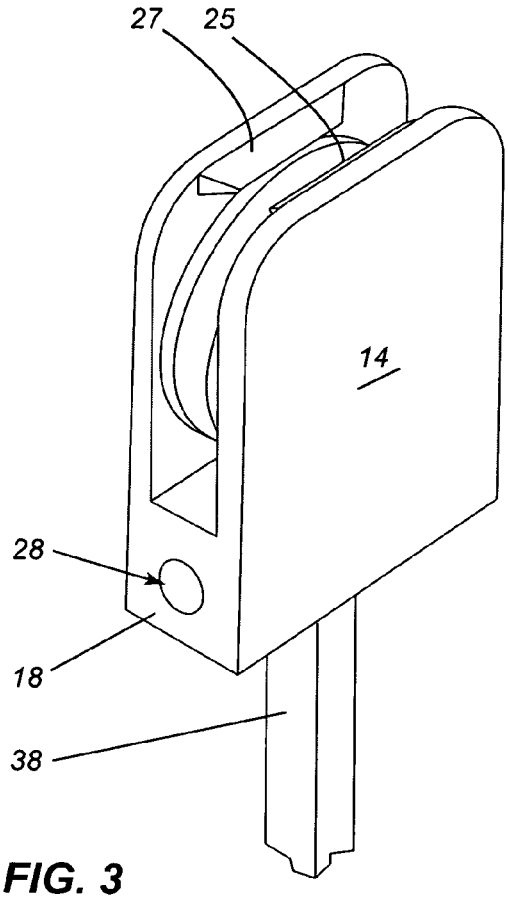
FIG. 3 is a perspective view of the upper housing and roller of the roller assembly.
Figure 4:
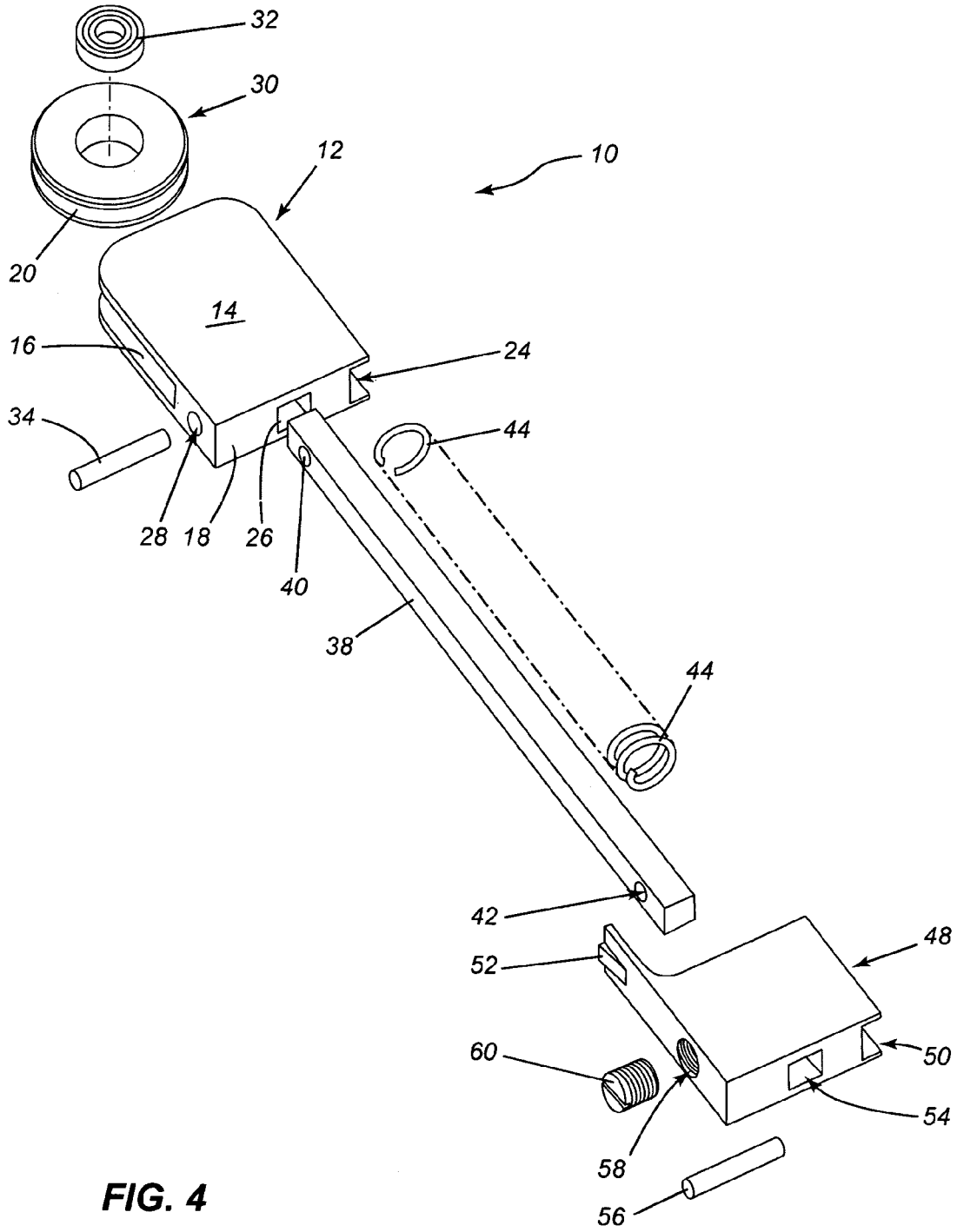
FIG. 4 is an exploded view of the roller assembly according to the present invention.
Figure 7:
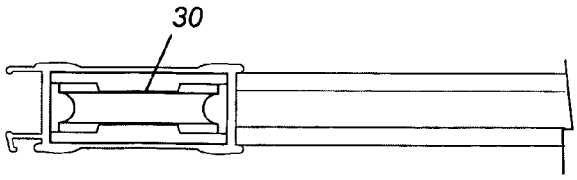
FIG. 7 is a side view of a roller assembly.
Figure 5:
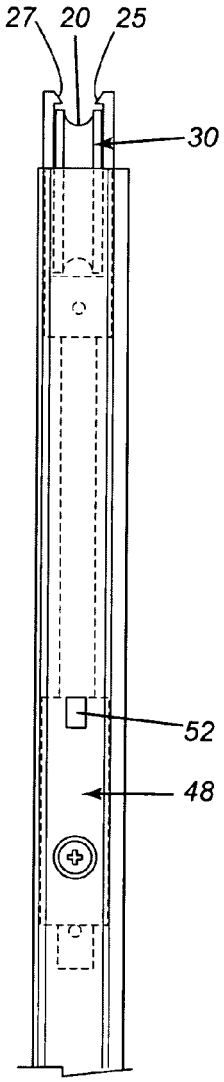
FIG. 5 is an end view of the roller assembly mounted in a sliding door.
Figure 6:
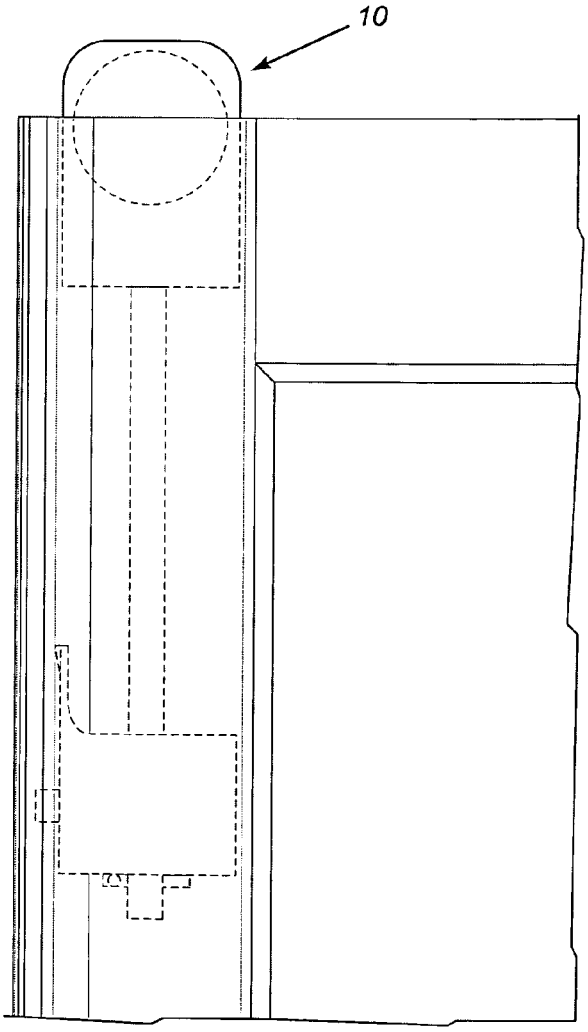
FIG. 6 is a front view thereof illustrating in dotted lines the roller assembly in a sliding door.

Referring to the drawings in greater detail, the roller assembly of the present invention is generally designated by reference numeral 10. As shown in FIG. 1, there may be two such roller assemblies—10 and 10' with further roller assemblies situated at the bottom of a door 8 if so desired.

Roller assembly 10 includes an upper housing generally designated by reference numeral 12. Upper housing 12 is of a generally U-shaped configuration having a first side wall 14, a second side wall 16, and a bottom wall 18. A channel 24 is formed between the side walls for fitting within the doorframe. First and second flanges 25, 27 extend inwardly from respective side walls 14, 16.

The bottom recess 26 is formed for purposes which will be described hereinbelow. A channel 28 extends through bottom wall 18.

A wheel 30 fits between walls 14 and 16 and has a bearing 32 associated therewith. Wheel 30 has a concave surface 20. For mounting purposes, a pair circular projections (not shown) may be provided on the interior of each of side walls 14 and 16 and wheel 30 press fitted therebetween.

A shaft 38 is provided and in the illustrated embodiment, is of a square cross-sectional configuration. An aperture 40 is provided at the upper end of a shaft 38 and a second aperture 42 is provided at a lower then end thereof. A coil spring 44 is designed to be mounted about shaft 38.

A lower housing 48 also has a side wall channel 50 formed therein for purposes similar to that of channel 24. On an opposite wall, a projection 52 is provided for retaining lower housing 48 in a desired position. A channel 54 extends through lower housing 48 and is designed to receive shaft 38. A locking pin or retaining pin 56 is designed to fit within lower aperture 42 to retain shaft 38 in a desired position.

A threaded aperture 58 extends partially through lower housing 48 and is designed to receive a threaded member 60 which, when fully threaded inwardly, will engage and abut shaft 38 to retain the same in position as discussed hereinbelow.

In use, shaft 38 is inserted through aperture 54 and pin 56 inserted in aperture 42 to retain shaft 38 in position. Similarly, shaft 38, at its upper end, enters recess 26 and pin 34 is placed in channel 28 and through aperture 40 of shaft 38. Wheel 30 is mounted between side walls 14 and 16 as described above.

Spring 44 biases upper housing 12 and lower housing 48. When desired, upper housing 14 and lower housing 48 may be moved towards each other and threaded member 60 is turned to engage shaft 38 to retain upper housing 12 in a lowered position. When desired, threaded member 60 is loosened and upper housing 12 with wheel 30 will move upwardly to seat itself in position.

It will be understood that the above described embodiment is for purposes of illustration only and that changes and modifications may be made thereto without departing from the spirit and scope of the invention.

I claim:

1. A method of installing a screen door within a door frame comprising the steps of:

supplying the screen door having a screen door frame, a screen extending about an aperture, and first and second roller mechanisms in an upper portion of said door, each of said roller mechanisms having an upper housing, a roller having a concave surface mounted in said upper housing, a shaft extending into said housing with a longitudinal axis that intersects and is perpendicular to a rotational axis of said roller, said shaft being located below said upper housing and said roller, a spring extending about said shaft, a lower housing moveable along a lower portion of said shaft and means for securing said lower housing to said shaft at a desired location below said upper housing and within said screen door;

placing said screen door within said door frame at a desired location; and releasing each of said means for securing said lower housing to said shaft whereby said upper housings and rollers will move such that both said upper housings and rollers extend outwardly of said screen door frame to thereby lock said screen door in position.

2. The method of claim 1 wherein each, of said upper housings has a generally U-shaped configuration comprising first and second side walls and a bottom wall, first and second flanges extending inwardly towards each other from an upper end of each of said first and second side walls.

3. The method of claim 1 wherein said step of releasing each of said means for securing said lower housing to said shaft comprises turning a threaded member engagable with a threaded aperture in each of said lower housings whereby said threaded member can abut said respective shaft.

4. The method of claim 1 wherein each of said upper housings is mounted on said respective shaft by means of a pin member extending through said respective shaft and an aperture formed in each of said upper housings.

5. The method of claim 1 wherein each of said upper housings includes inwardly extending flanges to retain said rollers in position.

* * * * *